US007017378B2

(12) United States Patent
Hsieh

(10) Patent No.: US 7,017,378 B2
(45) Date of Patent: Mar. 28, 2006

(54) PADLOCK

(76) Inventor: Hui-Hua Hsieh, P.O. Box 90, Tainan City (TW)

( * ) Notice: Subject to any disclaimer, the term of this patent is extended or adjusted under 35 U.S.C. 154(b) by 217 days.

(21) Appl. No.: 10/666,042

(22) Filed: Sep. 22, 2003

(65) Prior Publication Data

US 2005/0061039 A1 Mar. 24, 2005

(51) Int. Cl.
*E05B 67/06* (2006.01)

(52) U.S. Cl. ..... 70/49; 70/25; 70/38 A; 70/85 B

(58) Field of Classification Search ..... 70/31, 70/38 R–38 C, 39, 52, 53, 49, 233
See application file for complete search history.

(56) References Cited

U.S. PATENT DOCUMENTS

| | | | | | |
|---|---|---|---|---|---|
| 1,895,655 | A * | 1/1933 | Fraim | 70/38 B |
| 1,908,582 | A * | 5/1933 | Walz | 70/38 B |
| 1,938,941 | A * | 12/1933 | Soref | 70/38 B |
| 2,011,515 | A * | 8/1935 | Fraim | 70/38 C |
| 2,070,012 | A * | 2/1937 | Jacobi | 70/38 B |
| 2,370,991 | A * | 3/1945 | Ohno | 70/38 A |
| 2,379,437 | A * | 7/1945 | Hines et al. | 70/38 A |
| 2,408,137 | A * | 9/1946 | Gray et al. | 70/38 A |
| 3,254,516 | A * | 6/1966 | Tornoe et al. | 70/38 A |
| 3,422,644 | A * | 1/1969 | Foote | 70/38 B |
| 4,290,280 | A * | 9/1981 | Yun | 70/38 A |
| 4,419,873 | A * | 12/1983 | Sopko | 70/38 A |
| 4,776,187 | A * | 10/1988 | Evans et al. | 70/38 A |
| 4,838,051 | A * | 6/1989 | Yang | 70/38 A |
| 4,881,387 | A * | 11/1989 | Kortenbrede | 70/39 |
| 5,009,087 | A * | 4/1991 | Long | 70/49 |
| 5,070,713 | A * | 12/1991 | Chen | 70/38 B |
| 5,186,029 | A * | 2/1993 | Myers | 70/38 A |
| 5,727,405 | A * | 3/1998 | Cromwell | 70/38 B |
| 5,746,075 | A * | 5/1998 | Yang | 70/25 |
| 5,755,121 | A * | 5/1998 | Crass | 70/52 |
| 5,819,560 | A * | 10/1998 | Grahovec et al. | 70/38 A |
| 6,047,575 | A * | 4/2000 | Larson et al. | 70/278.1 |
| 6,453,706 | B1 * | 9/2002 | Chen | 70/33 |
| 6,508,086 | B1 * | 1/2003 | Chen | 70/49 |

* cited by examiner

*Primary Examiner*—Suzanne Dino Barrett

(57) ABSTRACT

A padlock is locked by inserting a key into the keyhole and turned to rotate the rotary member of a lock core together with a stop block to let the engage groove of the stop block be disengaged from the annular groove of a movable bolt and make a spring extend outward, and thus the movable bolt can be drawn out of the movable-bolt insert hole of an upper base. Then, the steel cable of the padlock is wound around an article to be locked, and the movable bolt is inserted in the movable-bolt insert hole of an upper base and the insert hole of a lower base. Meanwhile, the stop block is moved to its original position by the spring and its engage groove is engaged with the annular groove of the movable bolt, letting the movable bolt be locked stably.

4 Claims, 4 Drawing Sheets

PADLOCK

BACKGROUND OF THE INVENTION

1. Field of the Invention

This invention relates to a padlock, and particularly to one able to be assembled conveniently and quickly, having excellent effect of antitheft and greatly lowering producing cost. In using, only insert a key in the keyhole of a lock core and turn it around to rotate the rotary member of the lock core together with a stop block to let the engage groove of the stop block be disengaged from the annular groove of a movable bolt and make a spring extend elastically. At this time, the movable bolt is no longer held by the engage groove of the stop block so it can be drawn out of the movable bolt insert hole of an upper base. Then, a steel cable having one end secured in the upper base is wound around an article to be locked and the movable bolt is inserted through the movable bolt threading hole of an upper shell and positioned in the movable bolt insert hole of the upper base and the insert hole of a lower base. Simultaneously, the stop block is pulled and moved to its original position by the recovering resilience of the spring and has its engage groove engaged with the annular groove of the movable bolt to stably lock the movable bolt in a lock body, thus finishing locking of a padlock.

2. Description of the Prior Art

A conventional laminated lock 1, as shown in FIG. 1, includes a lock core body 10 made of a number of steel plates 100 piled up and combined together by rivets 101. The lock core body 10 has its left topside secured with a stationary stud 11 having an insert hole 12 and its right topside bored with a deadlock hole 13. A steel cable 14 has one end inserted in the insert hole 12 of the stationary stud 11 and then the stationary stud 11 has its side wall compressed so as to squeeze and fix the end of the steel cable 14 therein, with the exterior of the steel cable 14 wrapped by a soft protective sleeve 15. The steel cable 14 has the other end secured with a movable deadbolt 16 having an annular engage groove 17 near the end and a spring 18 fitted thereon. In using, the deadlock 16 has its end inserted in the deadlock hole 13 of the lock core body 10, and a key is inserted in the keyhole of the lock core body 10 and turned around to rotate the lock core (not shown) together with the engage plates inside the lock core body 10 to lock the deadbolt 16, thus finishing locking of a conventional laminated lock. On the contrary, to unlock the laminated lock 1, just turn the key reversely to actuate the engage plates inside the lock core body 10 to release the deadbolt 16.

However, the lock core body 10 of a conventional laminated lock 1 is made by piling together a number of steel plates 100 with different shaped insert and through holes, and then these steel plates 100 are riveted together, taking too much time and labor in assembly. Especially, if any one of the steel plates 100 is arranged mistakenly during assembling, the steel plates 100 have to be disassembled one by one and rearranged, resulting in much delay in assembly and increasing its producing cost.

SUMMARY OF THE INVENTION

The objective of the invention is to offer a padlock, convenient to be assembled, able to lower producing cost and having excellent effect of antitheft.

The feature of the invention is an upper base having a recessed chamber formed in the interior and a cut surface defining one side of the recessed chamber and having a movable-bolt insert hole, the upper base further bored with a stationary-bolt insert hole. A lower base to be combined with the upper base is provided with a cut surface with an insert hole on the inner side and has a lock core accommodating chamber in the center and a through hole communicating with the lock core accommodating chamber. A lock core received in the lock core-accommodating chamber of the lower base has one end provided with a rotary member and the other end bored with a keyhole. A stop block to be received in the recessed chamber of the upper base is provided with an insert hole in the center and an engage groove at the right end, with the lower end of a spring hooked with the right end of the stop block and the upper end of the spring hooked with the upper base. A stationary bolt to be inserted in the stationary-bolt insert hole of the upper base is formed with an annular groove and an axial insert hole. A movable bolt is to be inserted in the movable-bolt insert hole of the upper base and the insert hole of the lower base, having an annular groove and an axial insert hole. An upper shell to be covered on the exterior of the upper base is provided with a stationary-bolt threading hole and a movable-bolt threading hole. A lower shell to be covered on the interior of the lower base and combined with the upper shell is bored with a through hole in the center.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
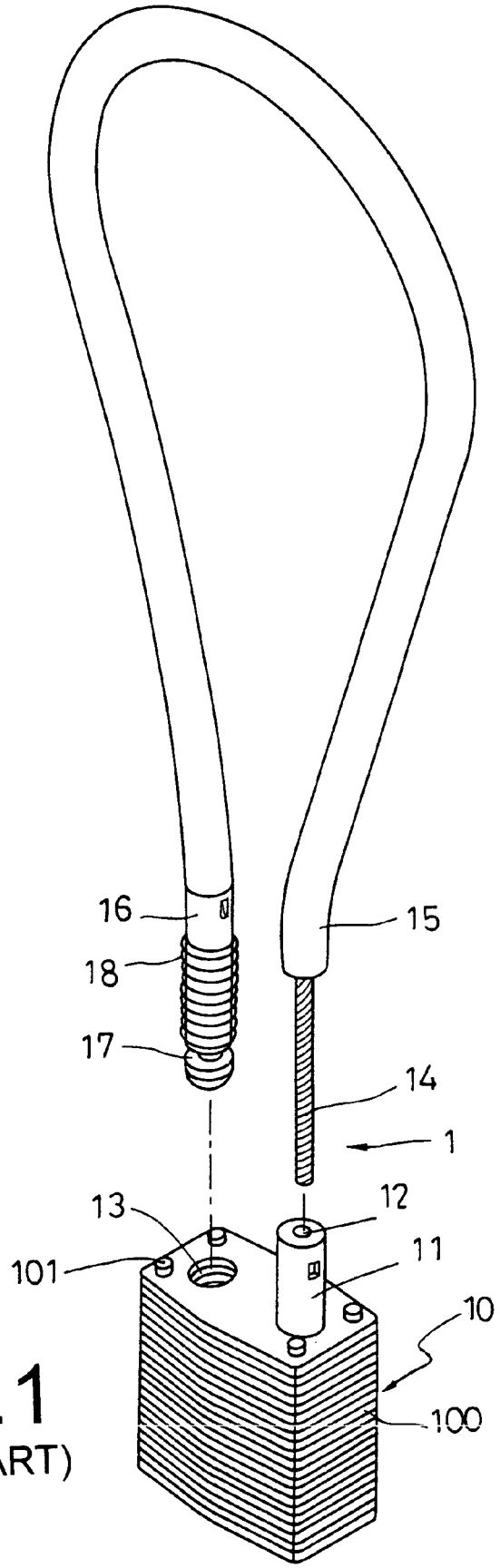
FIG.1 (PRIOR ART)
FIG. 1 is a perspective view of a conventional laminated lock.
Figure 2:
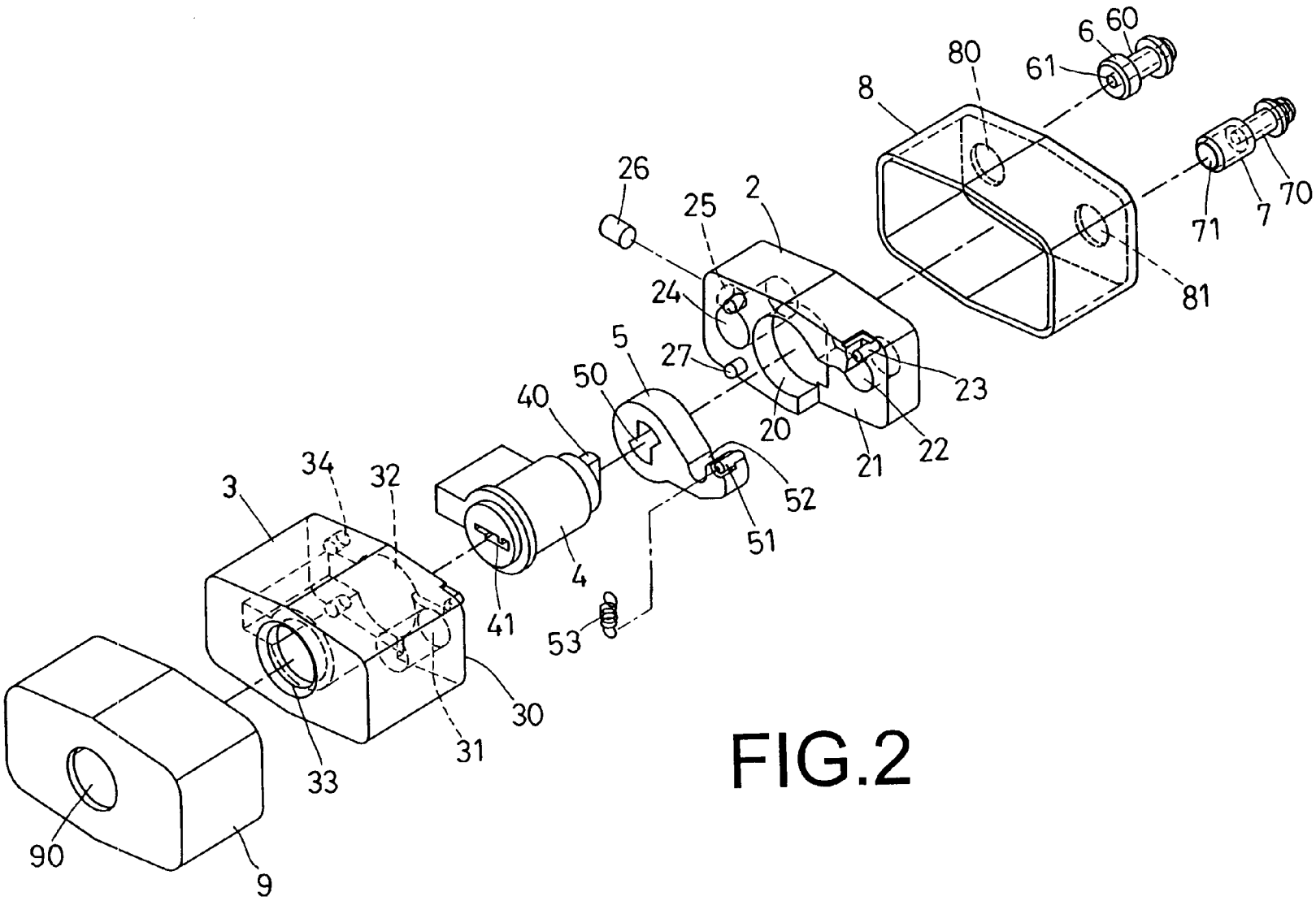
FIG. 2 is an exploded perspective view of a padlock in the present invention.
Figure 3:
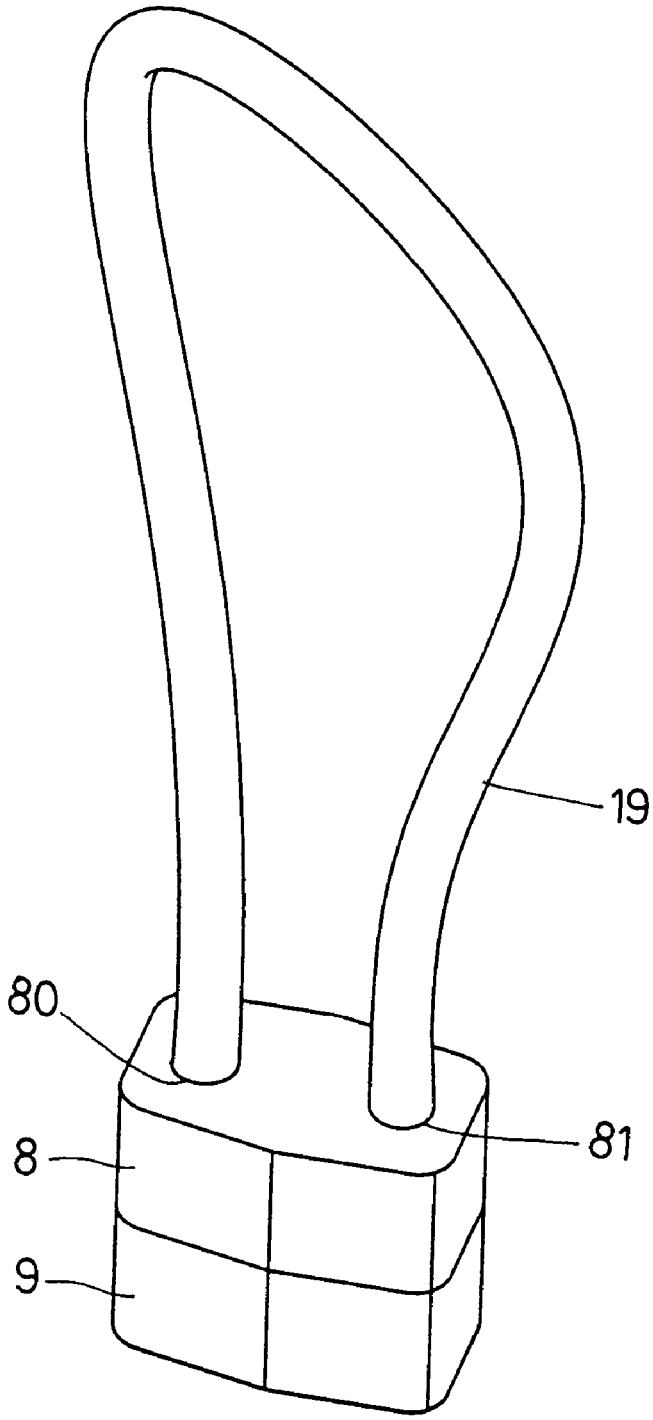
FIG. 3 is a perspective view of the padlock in the present invention.

A preferred embodiment of a padlock in the present invention, as shown in FIGS. 2 and 3, includes an upper base 2, a lower base 3, a lock core 4, a stop block 5, a stationary bolt 6, a movable bolt 7, an upper shell 8 and a lower shell 9 which are combined together.

The upper base 2 is formed with a recessed chamber 20 in an interior thereof and a cut surface 21 defining one side of the recessed chamber 20 and provided with a movable-bolt inserting hole 22 and a horizontal projecting stud 23. Further, the upper base 2 is provided with a stationary-bolt inserting hole 24 in a left portion, a pinhole 25 in the left sidewall for a fixing pin 26 to be inserted therein and two positioning studs 27 on the front side.

The lower base 3 to be combined with the upper base 2 has a cut surface 30 formed on an inner side thereof and bored with a lengthwise insert hole 31 and also having a lengthwise lock core accommodating chamber 32 in a center thereof. Further, the lower base 3 is bored with a through hole 33 communicating with the lock core accommodating chamber 32 and two stud holes 34 in the inner side.

The lock core 4 to be received in the lock core-accommodating chamber 32 of the lower base 3 has one end provided with a rotary member 40 and the other end formed with a keyhole 41.

The stop block 5 to be received in the recessed chamber 20 of the upper base 2 has its central part bored with an insert hole 50 and its right end provided with a horizontal projecting stud 51 and an engage groove 52, with one end of a spring 53 hooked with the projecting stud 51.

The stationary bolt 6 to be inserted and fixed in the stationary-bolt inserting hole 24 of the upper base 2 is formed with an annular groove 60 and an axial insert hole 61.

The movable bolt 7 is to be inserted in the movable-bolt inserting hole 22 of the upper base 2 and the insert hole 31 of the lower base 3, having an annular groove 70 and an axial insert hole 71.

The upper shell 8 to be covered on an exterior of the upper base 2 is bored with a stationary-bolt insert hole 80 and a movable-bolt insert hole 81.

The lower shell 9 to be covered on the exterior of the lower base 3 and combined with the upper shell 8 is bored with a through hole 90 in the center.

Figure 4:
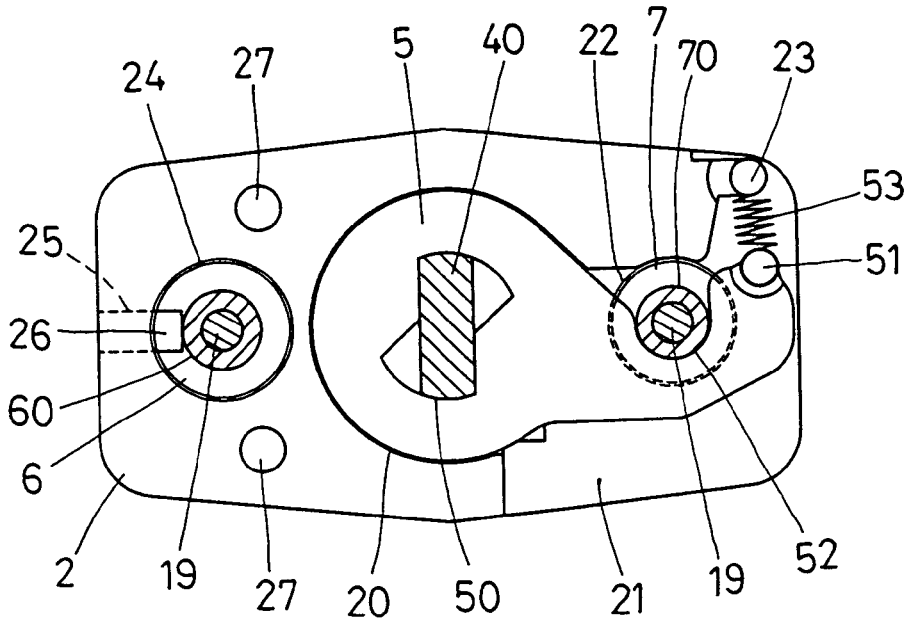
FIG. 4 is a cross-sectional view of the padlock in a locked condition in the present invention; and, FIG. 5 is a cross-sectional view of the padlock in an unlocked condition in the present invention.

In assembling, as shown in FIGS. 2, 3 and 4, firstly, insert one end of a steel cable 19 in the axial insert hole 61 of the stationary bolt 6 and compress the inner wall of the annular groove 60 of the stationary bolt 6 to squeeze and fix the end of the steel cable 19 therein and then insert the other end of the steel cable 19 in the axial insert hole 71 of the movable bolt 7 and compress the inner wall of the annular groove 70 of the movable bolt 7 to squeeze and fix the end of the steel cable 19 therein. Then, the stationary bolt 6 is inserted through the stationary-bolt threading hole 80 of the upper shell 8 and positioned in the stationary-bolt insert hole 24 of the upper base 2 and fixed therein by a fixing pin 26 inserted through the pin hole 25 of the upper base 2 and engaged in the annular groove 60 of the stationary bolt 6.

Next, the stop block 5 is received in the recessed chamber 20 and has its right end positioned on the cut surface 21 of the upper base 2, and the spring 53 has its lower end fitted on the projecting stud 51 of the stop block 5 and its upper end fitted on the projecting stud 23 of the upper base 2, letting the engage groove 52 of the stop block 5 be aligned to the movable-bolt insert hole 22 of the upper base 2. Subsequently, the lock core 4 is fitted in the lock core accommodating chamber 32 of the lower base 3, and the upper base 2 and the lower base 3 are combined together, letting the positioning studs 27 of the upper base 2 be inserted in the stud holes 34 of the lower base 3. Afterward, the rotary member 40 of the lock core 4 is inserted in the insert hole 50 of the stop block 5, and the upper shell 8 is covered on the exterior of the upper base 2 and the lower shell 9 is covered on the exterior of the lower base 3.

Lastly, the upper shell 8 and the lower shell 9 are combined and welded together and their exteriors are enveloped with a wrapping material to complete a padlock body. Then, the movable bolt 7 is inserted through the movable-bolt threading hole 81 of the upper shell 8 and positioned in the movable-bolt insert hole 22 of the upper base 2 and the insert hole 31 of the lower base 3 to finish assembly of the padlock.

Figure 5:
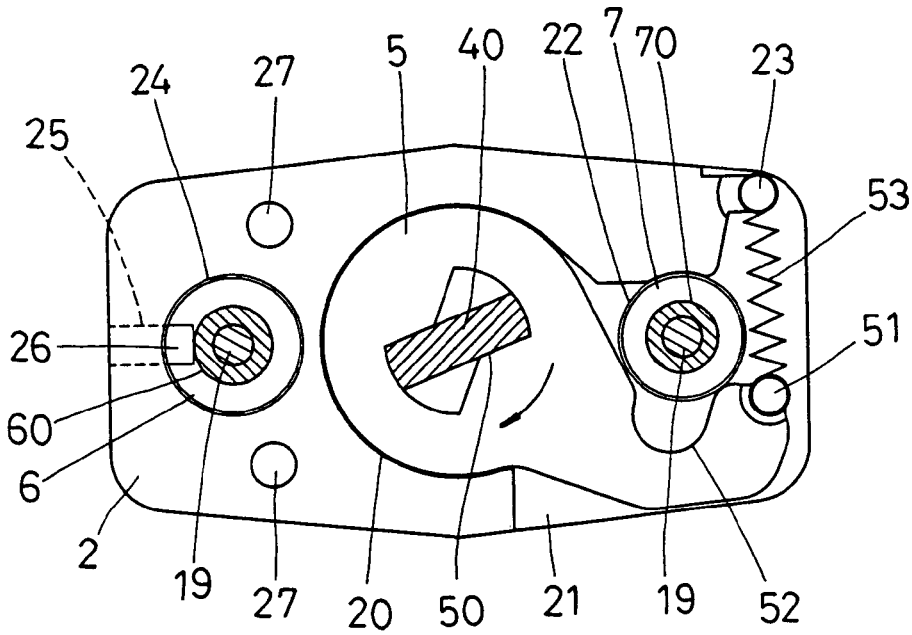

In using, as shown in FIGS. 4 and 5, a key is inserted in the keyhole 41 of the lock core 4 and turned around to rotate the rotary member 40 of the lock core 4 together with the stop block 5 to disengage the engage groove 52 of the stop block 5 from the annular groove 70 of the movable bolt 7 and make the spring 53 extended elastically, letting the movable bolt 7 no longer be held by the engage groove 52 of the stop block 5, and at this time the movable bolt 7 can be drawn out of the movable-bolt insert hole 22 of the upper base 2. Then, the steel cable 19 is wound around an article to be locked and the movable bolt 7 is inserted through the movable-bolt threading hole 81 of the upper shell 8 and positioned in the movable-bolt insert hole 22 of the upper base 2 and the insert hole 31 of the lower base 3.

When the movable bolt 7 passes through the movable-bolt insert hole 22 of the upper base 2 to be inserted in the insert hole 31 of the lower base 3, its end will push the stop block 5 downward to let the end of the stop block 5 be turned and disengaged from the movable-bolt insert hole 22 of the upper base 2 and the spring will be elastically pulled and extended. After the movable bolt 7 has its end inserted and positioned in the insert hole 31 of the lower base 3, the annular groove 70 of the movable bolt 7 is positioned in the engage groove 52 of the stop block 5 and the end of the stop block 5 is no longer pushed by the end of the movable bolt 7. Therefore, the stop block 5 is pulled and moved to its original position by the recovering resilience of the spring 53 and its engage groove 52 is fixedly engaged with the annular groove 70 of the movable bolt 7, letting the movable bolt 7 be locked stably in the lock body to finish locking of the padlock.

To unlock the padlock, as shown in FIG. 5, only insert a key in the keyhole 41 of the lock core 4 and turn it around to rotate the rotary member 40 of the lock core 4 together with the stop block 5 to disengage the engage groove 52 of the stop block 5 from the annular groove 70 of the movable bolt 7 and make the spring 53 extended elastically. Thus, the movable bolt 7 is no longer held by the engage groove 52 of the stop block 5 so it can be drawn out of the movable-bolt insert hole 22 of the upper base 2 to finish unlocking of the padlock.

As can be noted from the above description, this invention has the following advantages.

1. It is convenient in operating and using.
2. It can be assembled conveniently and quickly, able to lower its producing cost.
3. The movable bolt in this invention can be locked stably, having excellent effect of antitheft.

While the preferred embodiment of the invention has been described above, it will be recognized and understood that various modifications may be made therein the appended claims are intended to cover all such modifications that may fall within the spirit and scope of the invention.

What is claimed is:

1. A padlock comprising:

an upper base formed with a recessed chamber in an interior and with a cut surface defining said recessed chamber, said cut surface provided with a movable-bolt insert hole at a right end of the upper base, said upper base further bored with a stationary-bolt insert hole at a left end of the upper base;

a lower base combined with said upper base and formed with a cut surface on an inner side, said cut surface bored with an insert hole, said lower base provided with a lock core accommodating chamber in the center and further bored with a through hole communicating with said lock core accommodating chamber;

a lock core received in said lock core accommodating chamber of said lower base, said lock core having one end provide with a rotary member and the other end bored with a keyhole;

a stop block received in said recessed chamber of said upper base, said stop block bored with an insert hole in a center thereof and having an right end formed with an engage groove, a spring having an lower end fitted on said right end of said stop block, said spring having an upper end fitted on said upper base; wherein the engage groove is extended to the right side of the movable-bolt insert hole so that the engage groove at the right side of the stop block can enclose and buckle the movable bolt as the movable bolt is inserted into the movable-bolt insert hole;

a stationary bolt inserted in said stationary bolt insert hole of said upper base, said stationary bolt provided with an annular groove and an axial insert hole;

a movable bolt inserted in said movable-bolt insert hole of said upper base and said insert hole of said lower base, said movable bolt provided with an annular groove and an axial insert hole; wherein since said engage groove is extended to the right side of the movable-bolt insert hole so that the engage groove at the right side of the stop block can enclose and buckle the movable bolt as the movable bolt is inserted into the movable-bolt insert hole;

an upper shell covered on the exterior of said upper base and provided with a stationary-bolt threading hole and a movable-bolt threading hole; and, a lower shell covered on the exterior of said lower base and combined with said upper shell, said lower shell bored with a through hole in the center.

2. The padlock as claimed in claim 1, wherein said upper base is bored with a pin hole in one side wall for a fixing pin to be inserted therethrough to fix said stationary bolt in position.

3. The padlock as claimed in claim 1, wherein said upper base is provided with plural positioning studs inside, and said lower base is bored with plural stud holes for said positioning studs of said upper base to respectively fit therein so as to combine said upper and said lower base together.

4. The padlock as claimed in claim 1, wherein said cut surface of said upper base is provided with a horizontal projecting stud for hooking the upper end of said spring, and said stop block is provided with a horizontal projecting stud at the right end for hooking the lower end of said spring.

* * * * *